US005250076A

United States Patent [19]

Behler et al.

[11] Patent Number: 5,250,076

[45] Date of Patent: Oct. 5, 1993

[54] USE OF MONOCARBOXYLIC-ACID POLYOXYALKYLESTER SULFONATES AS LOW-FOAM TEXTILE CONDITIONING AGENT

[75] Inventors: Ansgar Behler, Bottrop; Bernd Fabry, Korschenbroich; Bernd Wahle, Kaarst; Hildegard von Delden, Hilden, all of Fed. Rep. of Germany

[73] Assignee: Henkel Kommanditgesellschaft auf Aktien, Duesseldorf, Fed. Rep. of Germany

[21] Appl. No.: 721,585

[22] PCT Filed: Jan. 4, 1990

[86] PCT No.: PCT/EP90/00012

§ 371 Date: Jul. 11, 1991

§ 102(e) Date: Jul. 11, 1991

[87] PCT Pub. No.: WO90/08181

PCT Pub. Date: Jul. 26, 1990

[30] Foreign Application Priority Data

Jan. 12, 1989 [DE] Fed. Rep. of Germany ..... 3900699

[51] Int. Cl.[5] ..... D06L 3/00

[52] U.S. Cl. ..... 8/111; 252/94; 252/95; 252/99; 252/555; 554/94; 554/97

[58] Field of Search ..... 8/111; 260/400; 252/555, 94, 95, 99

[56] References Cited

U.S. PATENT DOCUMENTS 4,861,506 8/1989 Chauvier et al. ..... 252/94
4,936,551 6/1990 Behler et al. ..... 252/555
4,963,157 10/1990 Machida et al. ..... 8/111

*Primary Examiner*—Allen M. McAvoy
*Attorney, Agent, or Firm*—Ernest G. Szoke; Wayne C. Jaeschke; Norvell E. Wisdom, Jr.

[57] ABSTRACT

The use of alkali, ammonium, and/or amine salts of monocarboxylic acid polyoxyalkylester sulfonic acids as low foam surface active agents in aqueous alkaline conditioners for textile fabrics or yarns is described.

14 Claims, No Drawings

USE OF MONOCARBOXYLIC-ACID POLYOXYALKYLESTER SULFONATES AS LOW-FOAM TEXTILE CONDITIONING AGENT

BACKGROUND OF THE INVENTION

1. Field of the Invention

This invention relates to the use of monocarboxylic acid polyoxyalkyl ester sulfonates as low-foam wetting agents in aqueous alkaline conditioning compositions for textile fabrics.

2. Statement of Related Art

Most of the conditioning compositions used for the pretreatment and bleaching of natural fibers, for example cotton, or blends of natural and/or synthetic fibers, for example cotton/polyester or cotton/polyamide, including mercerizing liquors, kier boiling liquors, detergents and bleaches, require the addition of wetting agents to establish relatively rapid and intimate contact between the treatment composition and the textile fabrics. Wetting agents suitable for alkaline conditioning compositions of the type in question must be soluble in water and stable to alkalis and must guarantee uniform wetting of the material. In addition, wetting agents of the type in question must be "environment-friendly", i.e. biodegradable and non-toxic to aquatic organisms.

Since the pretreatment and bleaching of textile fabrics is carried out in high-speed continuous or discontinuous machines, unwanted foaming readily occurs. To avoid this, alkali-stable foam inhibitors, for example silicones, are normally added to the conditioning compositions. However, the use of foam inhibitors not only involves additional costs, but it is often also accompanied by unwanted side effects, for example uneven wetting of the textile fabric and, in the case of silicone-containing foam inhibitors, silicone oil stains which are difficult to remove.

DESCRIPTION OF THE INVENTION

Accordingly, the problem addressed by the present invention was to provide silicone-free, low-foam, liquid and, hence, directly dispensable, water-soluble, alkali-stable and readily biodegradable wetting agents for textile fabrics or yarns which would fulfill all these product requirements in a single substance.

SUMMARY OF INVENTION

The invention is based on the surprising observation that the stringent requirements which wetting agents have to meet are satisfied by monocarboxylic acid polyoxyalkyl ester sulfonic acids in the form of their alkali, ammonium and/or amine salts.

Accordingly, the present invention relates to the use of alkali, ammonium and/or amine salts of carboxylic acid polyoxyalkyl ester sulfonic acids prepared by reaction of sulfur trioxide with monounsaturated monocarboxylic acid polyoxyalkyl esters corresponding to the following general formula $$C_mH_{2m-1}-\overset{\overset{\displaystyle O}{\|}}{C}-(OC_nH_{2n})_x-OR$$

in which R is a $C_{1-22}$ alkyl radical or a $C_{3-22}$ alkenyl radical, m is a number of 10 to 21, n is the number 2 and/or 3 and x is a number of 1 to 20, and subsequent reaction of the sulfonated monocarboxylic acid polyoxyalkyl esters obtained with aqueous alkalis as low-foam wetting agents in aqueous alkaline conditioning compositions for textile fabrics or yarns.

DESCRIPTION OF PREFERRED EMBODIMENTS

The salts of monocarboxylic acid polyoxyalkyl ester sulfonic acids may be prepared in known manner by sulfonation of monounsaturated monocarboxylic acid polyoxyalkyl esters with sulfuric acid, oleum, chlorosulfonic acid or $SO_3$-containing gas mixtures at temperatures of 5° to 120 ° C. The sulfonation of monounsaturated monocarboxylic acid polyoxyalkyl esters is preferably carried out in accordance with DE 37 20 000 at temperatures of 5° to 100 ° C. with gas mixtures of $SO_3$ and air or inert gases, for example nitrogen, in which the $SO_3$ content is between 1 and 10% by volume. In a particularly preferred embodiment, the sulfonation temperatures are in the range from 5° to 40° C. The molar ratio of monounsaturated monocarboxylic acid polyoxyalkyl ester to $SO_3$ is approximately 1:1.

The sulfonations are carried out continuously or discontinuously in reactors suitable and typically used for the sulfation of fatty alcohols or for the sulfonation of fatty acid esters, alkylbenzenes or olefins, preferably in falling film reactors (see for example Kirk-Othmer: Encyclopedia of Chemical Technology 22, 28 et seq. (1983)).

The sulfonation product obtained is subsequently hydrolyzed with an aqueous solution of alkali hydroxides, ammonium hydroxide and/or amines, the sulfonated reaction mixture preferably being added to the aqueous solution. 1 to 1.2 mol hydroxides and/or amines are used per mol added sulfur trioxide. Excess hydroxide and/or amine is necessary to neutralize the gaseous $SO_3$ dissolved in the sulfonation product. Sodium hydroxide, potassium hydroxide, diethanolamine and/or triethanolamine are preferably used as neutralization bases, sodium hydroxide being particularly preferred. The concentration of the hydroxides and/or amines in water is preferably selected so that the end product forms a low-viscosity solution.

In addition to the desired sulfonates, the reaction product also contains sultones. The formation of sultones in the sulfonation of olefinic double bonds is a reaction known per se. To convert the unwanted sultones in the reaction product into hydroxysulfonates and/or unsaturated sulfonates, the sulfonation products have to be subjected to a hydrolysis in which the reaction products are heated until the sultone groups formed are completely destroyed, a pH value of 7 being maintained by controlled addition of alkali hydroxide. The time required for this purpose is dependent on temperature and pressure. For example, complete hydrolysis can be achieved in 4 to 6 hours at boiling temperature under normal pressure and in a considerably shorter time under pressure at higher temperatures.

The monounsaturated monocarboxylic acid polyoxyalkyl ester starting materials, which correspond to the following general formula $$C_mH_{2m-1}-\overset{\overset{\displaystyle O}{\|}}{C}-(OC_nH_{2n})_x-OR,$$

are also obtainable by methods known from the literature. Their production starts out from aliphatic, natural and/or synthetic, saturated $C_{1-22}$ alcohols and/or aliphatic, natural and/or synthetic, unsaturated $C_{3-22}$ alcohols, for example methanol, ethanol, propanol, butanol, hexanol, octanol, decanol, cetyl alcohol, stearyl alcohol, behenyl alcohol, oleyl alcohol, palmitoleyl alcohol, linoleyl alcohol, erucic alcohol or technical alcohol cuts consisting predominantly of cetyl alcohol, stearyl alcohol, oleyl alcohol, palmitoleyl alcohol and/or linoleyl alcohol.

The alkoxylations of the alcohols with ethylene oxide and/or propylene oxide are carried out by known industrial methods (see, for example, Chemische Technologie, Vol. 7, pages 131 to 132, Carl-Hanser-Verlag, München (1986)). The average degree of alkoxylation x of the resulting mixtures of homologous alkoxylates corresponds to the molar quantity of alkylene oxides added on and is between 1 and 20 and preferably between 2 and 10.

The alkoxylated alcohols obtained are subsequently reacted with $C_{11-22}$ monounsaturated monocarboxylic acids in known manner in the presence of esterification catalysts, for example tin grindings. Suitable monounsaturated $C_{11-22}$ monocarboxylic acids are, for example, 10-undecenoic acid, palmitoleic acid, oleic acid, petroselic acid, elaidic acid and/or erucic acid. Oleic acid and/or erucic acid are preferably used either in pure form or in the form of fatty acid mixtures rich in oleic acid and erucic acid, as can be obtained from fats of animal and/or vegetable origin.

Preferred monounsaturated monocarboxylic acid polyoxyalkyl esters are those corresponding to the following general formula $$C_mH_{2m-1}-\overset{\overset{\displaystyle O}{\|}}{C}-(OC_nH_{2n})_x-OR$$

in which R is a $C_{8-18}$ alkyl radical, m is 17 and/or 21, n is 2 and/or 3 and x is a number of 2 to 10.

The wetting agents to be used in accordance with the alkaline solutions. If desired, they may be bleached with hydrogen peroxide solutions or alkali hypochlorite solutions (chloride of soda) in known manner at temperatures of 40° to 55 ° C. The addition of preservatives known from the prior art, for example p-hydroxybenzoate and/or sorbic acid, is advisable for protection against bacterial contamination. The solutions contain between 10 and 50% by weight active substance in the form of monocarboxylic acid polyoxyalkyl ester sulfonate salts.

Wetting agents containing monocarboxylic acid polyoxyalkyl ester sulfonate salts are distinguished by particularly low foaming. This is of particular advantage in strongly alkaline conditioning compositions, for example in alkaline cold bleach liquors, hot bleach liquors, mercerizing liquors, alkaline kier boiling and degreasing compositions, because alkaline conditioning compositions such as these have a particular tendency towards foaming.

The monocarboxylic acid polyoxyalkyl ester sulfonate salts are preferably used as low-foam wetting agents in aqueous alkaline bleaching liquors. These liquors contain hydrogen peroxide or compounds which form hydrogen peroxide in aqueous solution as the bleaching agent. The pH value of the bleaching baths is adjusted to 10–14 with strong bases, for example with NaOH and/or KOH. Known anionic and nonionic wetting agents, for example alkyl sulfates, sulfonates, carboxylates, phosphates and/or alkyl polyoxyethylene glycol ethers, which are stable and effective in these media, tend to foam vigorously in high-speed machines. For this reason, it is standard practice to add foam inhibitors, for example silicone oils. By contrast, the salts of monocarboxylic acid polyoxyalkyl ester sulfonic acids to be used in accordance with the invention generate hardly any foam in baths of the type in question, so that there is no need to add foam inhibitors. The bleaching liquors, which contain per liter from 10 to 100 ml of 35% by weight hydrogen peroxide, from 5 to 20 g of bases from the group of sodium and/or potassium hydroxide, from 5 to 50 ml of stabilizers, for example soda waterglass ($Na_2O$: $SiO_2$=1:2; 38–40° Bé) and/or alkali metal salts of ethylene diamine tetraacetic acid and/or polyphosphates, from 0.1 to 1.0 g of magnesium salts, for example magnesium sulfate, from 0.5 to 10 g of sequestering agent, for example Securon ® 540 (a product of Henkel KGaA), and 0.3 to 30 g, based on active substance, monocarboxylic acid polyoxyalkyl ester sulfonate salts, are applied to textile fabrics or yarns at temperatures of 15° to 90° C. and preferably at a temperature of around 20° C. (cold bleaching). The cotton-containing textile fabrics, such as woven and/or knitted fabrics, and yarns preferably treated with bleaching liquors containing monocarboxylic acid polyoxyalkyl ester sulfonate salts are distinguished by high degrees of whiteness and good hydrophilic properties.

EXAMPLES

EO stands for ethylene oxide

AS stands for active substance 1.1 Preparation of oleic acid-2.9EO-decyl ester sodium sulfonate In a standing laboratory reactor, 0.5 mol oleic acid-2.9EO-decyl ester was heated to 30° C. and 40 g (0.5 mol) sulfur trioxide (produced by vaporization of 65% by weight oleum) diluted with nitrogen ($SO_3$ content in the nitrogen stream=5% by volume) were subsequently introduced over a period of 50 minutes. Following a 30 minute after-reaction, the acidic sulfonation product was introduced into water at the same time as an aqueous 25% by weight sodium hydroxide solution. The mixture was then heated to 90° C. and NaOH was added until a constant pH value of 7 had been established. The reaction product obtained was clearly soluble in water and had the following characteristics:

Washing-active substance (DGF method H-III-10)=19.8% by weight

Sodium sulfate content =0.7% by weight

Klett color value (NaOCl bleach; 1 cm cuvette)=45

1.2 Preparation of oleic acid oleyl ester sodium sulfonate (comparison)

539 g (1 mol) oleic acid oleyl ester (iodine value=98, saponification value =105) were introduced into a 1 liter sulfonation reactor equipped with a gas inlet pipe and jacket cooling and reacted at 40° to 45° C. with 88 g (1.2 mol) of gaseous sulfur trioxide. Sulfur trioxide was driven out by heating from a corresponding quantity of oleum, diluted with nitrogen to a concentration of 5% by volume and introduced into the oleic acid oleyl ester over a period of 70 minutes, during which the temperature of the reaction mixture was kept below 60° C. by cooling. After sulfonation, the acidic reaction mixture was cooled to 10° C. and bleached in portions with 5% by weight of a 35% by weight hydrogen peroxide solution, the temperature of the mixture again being kept below 60° C. by cooling. The bleached product was then stirred into a solution of 48 g (1.2 mol) of NaOH in 250 ml in 250 ml water and hydrolyzed for 4 hours at 95° C., the product separating. After cooling, the upper phase (approx. 10% by weight), which contained unsulfonated product, was removed. The lower phase containing oleic acid oleyl ester sodium sulfonate was adjusted with mineral acid to a pH value of 7.

| Characteristic data of the product: | |
|---|---|
| Anionic surfactant content (as measured by DGF-Einheits-methode H-III-10): | 28.0% by weight = 0.50 mval/g |
| Unsulfonated components (as measured by DGF-Einheits-methode G/III-6b): | 7.0% by weight |
| $Na_2SO_4$: | 2.0% by weight |
| Water (Fischer method): | 63.0% by weight |

2. Testing of wetting power a) The wetting power of 1 g AS/1 liquor of oleic acid-2.9EO-decyl ester sodium sulfonate prepared in accordance with Example 1.1 and, for comparison, the wetting power of 1 g AS/1 liquor of oleic acid oleyl ester sodium sulfonate prepared in accordance with Example 1.2 and of 1 g AS/liquor of oleic acid-2.9EO-decyl ester were determined in neutral and alkaline media at different temperatures in accordance with DIN 53 901. The following wetting times were determined:

| | Neutral | | Alkaline 1.2% by weight NaOH | | Alkaline 4% by weight NaOH | |
|---|---|---|---|---|---|---|
| | 20° C. | 60° C. | 20° C. | 60° C. | 20° C. | 60° C. |
| | (Wetting times in seconds) | | | | | |
| Oleic acid-2.9EO-decyl ester sodium sulfonate | 78 | 31 | 111 | 32 | 109 | 41 |
| For comparison: | | | | | | |
| Oleic acid oleyl ester sodium sulfonate | >300 | 96 | >300 | >300 | 104 | 135 |
| Oleic acid-2.9EO-decyl ester | >300 | >300 | >300 | >300 | >300 | >300 |

| b) Composition of the alkaline cold bleaching solution: | |
|---|---|
| Hydrogen peroxide, 35% by weight | 40 ml |
| Magnesium sulfate | 0.15 g |
| Waterglass 37/40° Bé | 15 ml |
| Sodium hydroxide, 50% by weight | 16 ml |
| Sequestering agent (Securon ® 540, a product of Henkel KGaA) | 2 g |
| Deionized water ad | 1000 ml |

Oleic acid-2.9EO-decyl ester sodium sulfonate prepared in accordance with Example 1.1 and, for comparison, oleic acid oleyl ester sodium sulfonate prepared in accordance with Example 1.2 or oleic acid-2.9EO-decyl ester were added to the bleaching liquors in different quantities as wetting agents. The wetting effect of these liquors was determined at 20° C. in accordance with DIN 53 901 (determination of the immersion wetting power of surfactant solutions). The following wetting times were obtained:

| Wetting agent | Quantity in g AS/l liquor | Wetting times in seconds |
|---|---|---|
| Oleic acid-2.9EO-decyl ester sodium sulfonate | 2.4 | 57 |
| | 4.8 | 12 |

-continued

| Wetting agent | Quantity in g AS/l liquor | Wetting times in seconds |
|---|---|---|
| For comparison: | | |
| Oleic acid oleyl ester sodium sulfonate | 2.4 | 218 |
| | 4.8 | 109 |
| Oleic acid-2.9EO-decyl ester | 2.4 | >300 |
| | 4.8 | 185 |

3. Testing of foaming behavior

The foaming behavior of the cold bleaching solutions (composition as in 2.b)), which contained 2.4 g AS/1 cold bleaching liquor of oleic acid-2.9EO-decyl ester sodium sulfonate and, for comparison, 2.4 g AS/1 cold bleaching liquor of oleic acid oleyl ester sodium sulfonate or 2.4 g AS/1 cold bleaching liquor of oleic acid-2.9EO-decyl ester as wetting agents, was tested at 20° C. in a Krantz dyeing machine (holding capacity: 25 l, liquor inflow from outside inwards, running time 15 minutes) (0% means no foam between the liquid surface and the rim of the container, 100% means that the space between the liquid surface and the rim of the container is completely filled with foam).

| | Foaming power in % |
|---|---|
| Oleic acid-2.9EO-decyl ester sodium sulfonate | 50 |
| For comparison: | |
| Oleic acid oleyl ester sodium sulfonate | 50 |
| Oleic acid-2.9EO-decyl ester | 50 |

What is claimed is:

1. An aqueous alkaline bleaching composition for textile fabrics or yarns, said bleaching composition comprising per liter from 10 to 100 ml of 35% by weight hydrogen peroxide, from 5 to 20 g of bases, from 5 to 50 of stabilizers, from 0.1 to 1.0 g of magnesium salts, from 0.5 to 10 g of sequestering agents, and from 0.3 to 30 g, based on active substance, of alkali, ammonium, or amine salts of carboxylic acid polyoxyalkyl ester sulfonic acids prepared by reaction of monounsaturated monocarboxylic acid polyoxyalkyl esters corresponding to the following general formula:

$$C_mH_{2m-1}-\overset{\overset{\displaystyle O}{\|}}{C}-(OC_nH_{2n})_x-OR,$$

in which R is a $C_{1-22}$ alkyl radical or a $C_{3-22}$ alkenyl radical, m is a number of 10 to 21, n is independently selected for each $OC_nH_{2n}$ group from the number 2 and the number 3, and x is a number from 1 to 20, with sulfur trioxide and subsequent reaction of the sulfonated monocarboxylic acid polyoxyalkyl esters obtained with aqueous alkalis.

2. An aqueous alkaline bleaching composition according to claim 1, wherein R is a $C_{8-18}$ alkyl radical, m is 17 or 21, and x is a number from 2 to 10.

3. A process for bleaching textile fabrics or yarns by contact of the fabrics or yarns with an aqueous alkaline bleaching composition, wherein said bleaching composition comprises per liter from 10 to 100 ml of 35% by weight hydrogen peroxide, from 5 to 20 g of bases, from 5 to 50 ml of stabilizes, from 0.1 to 1.0 g of magnesium salts, from 0.5 to 10 g of sequestering agents, and from 0.3 to 30 g, bases on active substance, of alkali, ammonium, or amine salts of carboxylic acid polyoxyalkyl ester sulfonic acids prepared by reaction of monounsaturated monocarboxylic acid polyoxyalkyl esters corresponding to the following general formula:

$$C_mH_{2m-1}-\overset{\overset{\displaystyle O}{\|}}{C}-(OC_nH_{2n})_x-OR,$$

in which R is a $C_{1-22}$ alkyl radical or a $C_{3-22}$ alkenyl radical, m is a number of 10 to 21, n is independently selected for each $OC_nH_{2n}$ group from the number 2 and the number 3; and x is a number from 1 to 20, with sulfur trioxide and subsequent reaction of the sulfonated monocarboxylic acid polyoxyalkyl esters obtained with aqueous alkalis.

4. A process according to claim 3, wherein the alkaline bleach is applied to the textile fabrics or yarns at a temperature in the range from 15° to 90° C.

5. A process according to claim 4, wherein the alkaline bleach is applied to the textile webs or yarns at a temperature of about 20° C.

6. A process according to claim 3, wherein, in the aqueous alkaline bleaching composition, R is a $C_{8-18}$ alkyl radical, m is 17 or 21, and x is a number from 2 to 10.

7. A process according to claim 6, wherein the alkaline bleach is applied to the textile fabrics or yarns at a temperature in the range from 15° to 90° C.

8. A process according to claim 7, wherein the alkaline bleach is applied to the textile webs or yarns at a temperature of about 20° C.

9. A process according to claim 6, wherein the textile fabrics or yarns treated contain cotton.

10. A process according to claim 9, wherein the alkaline bleach is applied to the textile fabrics or yarns at a temperature in the range from 15° to 90° C.

11. A process according to claim 10, wherein the alkaline bleach is applied to the textile webs or yarns at a temperature of about 20° C.

12. A process according to claim 3, wherein the textile fabrics or yarns treated contain cotton.

13. A process according to claim 12, wherein the alkaline bleach is applied to the textile fabrics or yarns at a temperature in the range from 15° to 90° C.

14. A process according to claim 13, wherein the alkaline bleach is applied to the textile webs or yarns at a temperature of about 20° C.

* * * * *